US005842508A

United States Patent [19]

Krupke et al.

[11] Patent Number: 5,842,508

[45] Date of Patent: Dec. 1, 1998

[54] HINGE ASSEMBLY FOR SECTIONAL DOOR

[75] Inventors: LeRoy G. Krupke, Carrollton; Foad Vafaie, Plano; James L. Grisham, Denison; David Scott Boucher, Rowlett, all of Tex.

[73] Assignee: Overhead Door Corporation, Dallas, Tex.

[21] Appl. No.: 789,784

[22] Filed: Jan. 29, 1997

[51] Int. Cl.[6] ..... E06B 3/12

[52] U.S. Cl. ..... 160/235; 16/261; 16/270; 16/355

[58] Field of Search ..... 160/201, 229.1, 160/235, 196.1, 199, 206, 207, 213, 133; 16/261, 270, 355, DIG. 1

[56] References Cited

U.S. PATENT DOCUMENTS

| | | | |
|---|---|---|---|
| 1,888,162 | 11/1932 | Eklund . | |
| 1,936,300 | 11/1933 | Guss | 189/46 |
| 2,263,995 | 11/1941 | Katulski | 160/201 |
| 2,300,265 | 10/1942 | Siess | 16/171 |
| 2,365,378 | 12/1944 | Benson | 16/171 |
| 2,391,845 | 12/1945 | Rowe | 160/201 |
| 2,641,018 | 6/1953 | Snyder | 16/178 |
| 2,644,553 | 7/1953 | Cushman | 189/36 |
| 2,880,796 | 4/1959 | Stroup | 160/232 |
| 2,886,102 | 5/1959 | Olsen et al. | 160/235 |
| 2,952,313 | 9/1960 | Stroup | 160/209 |
| 3,056,451 | 10/1962 | Federline et al. | 160/201 |
| 3,247,637 | 4/1966 | Robertson | 160/201 X |
| 3,359,594 | 12/1967 | Pastoor | 16/178 |
| 4,532,973 | 8/1985 | DeFalco | 160/235 |
| 4,771,816 | 9/1988 | Clay, Jr. | 160/235 |
| 4,909,296 | 3/1990 | Sellke et al. | 160/67 |
| 4,924,932 | 5/1990 | Esnault | 160/201 |
| 4,979,553 | 12/1990 | Lowry, III et al. | 160/133 |
| 5,148,850 | 9/1992 | Urbanick | 160/231 |
| 5,365,993 | 11/1994 | Jella | 160/201 |
| 5,564,164 | 10/1996 | Jella | 16/355 |

FOREIGN PATENT DOCUMENTS

| | | | |
|---|---|---|---|
| 382423B | 3/1985 | Austria . | |
| WO96/23948 | 8/1996 | WIPO | E06B 3/48 |

*Primary Examiner*—David M. Purol
*Attorney, Agent, or Firm*—Akin, Gump, Strauss, Hauer & Feld, L.L.P.

[57] ABSTRACT

An upward acting sectional door is formed of rectangular door sections which are interconnected to each other by a continuous hinge comprising opposed partial arcuate hinge members formed on a lower rail of an upper section and an upper rail of an adjacent lower section and engaged with a third hinge member comprising an elongated tubular pin having a D-shaped cross section. The hinge pin is secured against rotation by retainer members at opposite ends of one of the door sections. The hinge permits lateral assembly and disassembly of one door section relative to the other. Additional load bearing hinge members are provided connected to the lateral side edges of adjacent door sections and are interconnected by support members disposed in the tubular hinge pin for transferring part or all of the forces between adjacent door sections thereby allowing the arcuate hinge members to function substantially as cooperating light and weatherseal members and to provide a substantially pinch proof door.

33 Claims, 9 Drawing Sheets

HINGE ASSEMBLY FOR SECTIONAL DOOR

FIELD OF THE INVENTION

The present invention pertains to a sectional door, such as an upward acting garage door, including a hinge interconnecting each of the door sections.

BACKGROUND

Upward acting or vertical opening sectional doors are ubiquitous as residential garage doors and are also widely used in commercial door applications. There has been a continuing need to provide improvements in sectional doors of the general type referenced herein. One pressing need has been to reduce the weight of the door, particularly for doors used to close over openings in residential or commercial multi-car garages. These doors typically range in widths from eight to twenty feet and have a height of about seven feet. It is desirable to minimize the weight of the door while not sacrificing its strength and rigidity to provide a suitable secure closure over the garage vehicle entry. In this regard extrudable or moldable polymer materials have been given consideration for use as the main structural members of doors. However, the use of these materials with other door support components has posed certain problems with respect to providing a suitable hinge structure for connecting the door sections to each other.

Another problem associated with the development of sectional vertical opening doors as well as other doors which utilize multiple door sections or panels which are hinged to each other is the development of a suitable hinge structure which provides a long operating life, particularly with minimal or little maintenance, is adapted to minimize injury, such as by being configured to substantially prevent placement of a person's finger or fingers between the door sections during pivotal movement thereof, provides a suitable light and weatherseal, and provides for assembly of the door sections laterally with respect to each other instead of requiring a longitudinal end-to-end sliding fit of the door sections with respect to each other in order to assemble the hinge. At least certain problems associated with the development of sectional upward acting doors and certain desiderata for such doors have been substantially satisfied by the present invention.

SUMMARY OF THE INVENTION

The present invention provides an improved sectional door, such as an upward acting or vertical opening type door, including an improved hinge between adjacent door sections. The door is particularly adapted to be used for covering entries to residential and commercial garages and similar structures. The present invention also provides an improved hinge assembly, particularly useful for sectional doors and the like.

In accordance with one aspect of the present invention, a lightweight, sectional, upward acting door is provided which is formed of extrudable or moldable material, preferably extruded plastic, and is characterized by interconnected door sections having an improved hinge structure. Each door section may be formed of extruded longitudinal horizontal rails and interconnecting vertical stiles and removable inserts or panels. The longitudinal rails of adjacent door sections include integral hinge members which are cooperable to provide an improved door structure.

In accordance with still another aspect of the present invention a sectional door is provided wherein multiple door sections are hingedly connected to each other by a continuous hinge assembly wherein two components of the hinge assembly are partial arcuate bearing members which are interfitted with each other to provide a pivot connection between adjacent door sections, and at least one of the interconnected sections is adapted to support a third elongated hinge member in such a way that the hinge and the adjacent door sections may be assembled and disassembled laterally. When the hinge is assembled the third hinge member prevents disconnection between the partial arcuate hinge bearing members of the respective adjacent rails.

The present invention also provides a three part hinge assembly which is advantageous in that it provides for lateral assembly of one panel or section to the other, provides a continuous hinge over substantially the entire width of the door, provides a light seal and weatherseal and is of a substantially pinch proof construction to minimize the chance of injury to a person attempting to insert one or more fingers between the door sections.

The hinge assembly also provides a continuous hinge which has large bearing surface areas for providing a lightly stressed hinge connection between large door sections and the like. Moreover, the hinge construction does not require separate seal members or structure to provide the pinch proof feature.

In accordance with yet a further aspect of the present invention a three part hinge assembly is provided for interconnecting door sections and the like wherein the hinge assembly may be assembled and disassembled laterally, and one of the hinge members is provided with opposed retainer members which are operable to removably position and connect the one hinge member to one of the sections while permitting differential thermal expansion between the hinge member and the other components of the hinge assembly.

In accordance with still a further aspect of the present invention, a hinge assembly for interconnected door sections is provided wherein two interleaved, continuous members provide an improved light seal and weather seal, as well as a structure which minimizes the chance of injury to a person attempting to insert one or more fingers between the door sections. Moreover, load bearing hinge members are provided at each side edge of the door sections, respectively, for transferring a substantial portion of forces between adjacent door sections. The side edge hinge members, together with the interleaved continuous members, provide an improved hinge assembly, particularly for sectional garage doors and the like.

Those skilled in the art will further appreciate the above-described advantages and superior features of the invention together with other important aspects thereof upon reading the detailed description which follows in conjunction with the drawing.

DESCRIPTION OF THE PREFERRED EMBODIMENTS

Figure 1:
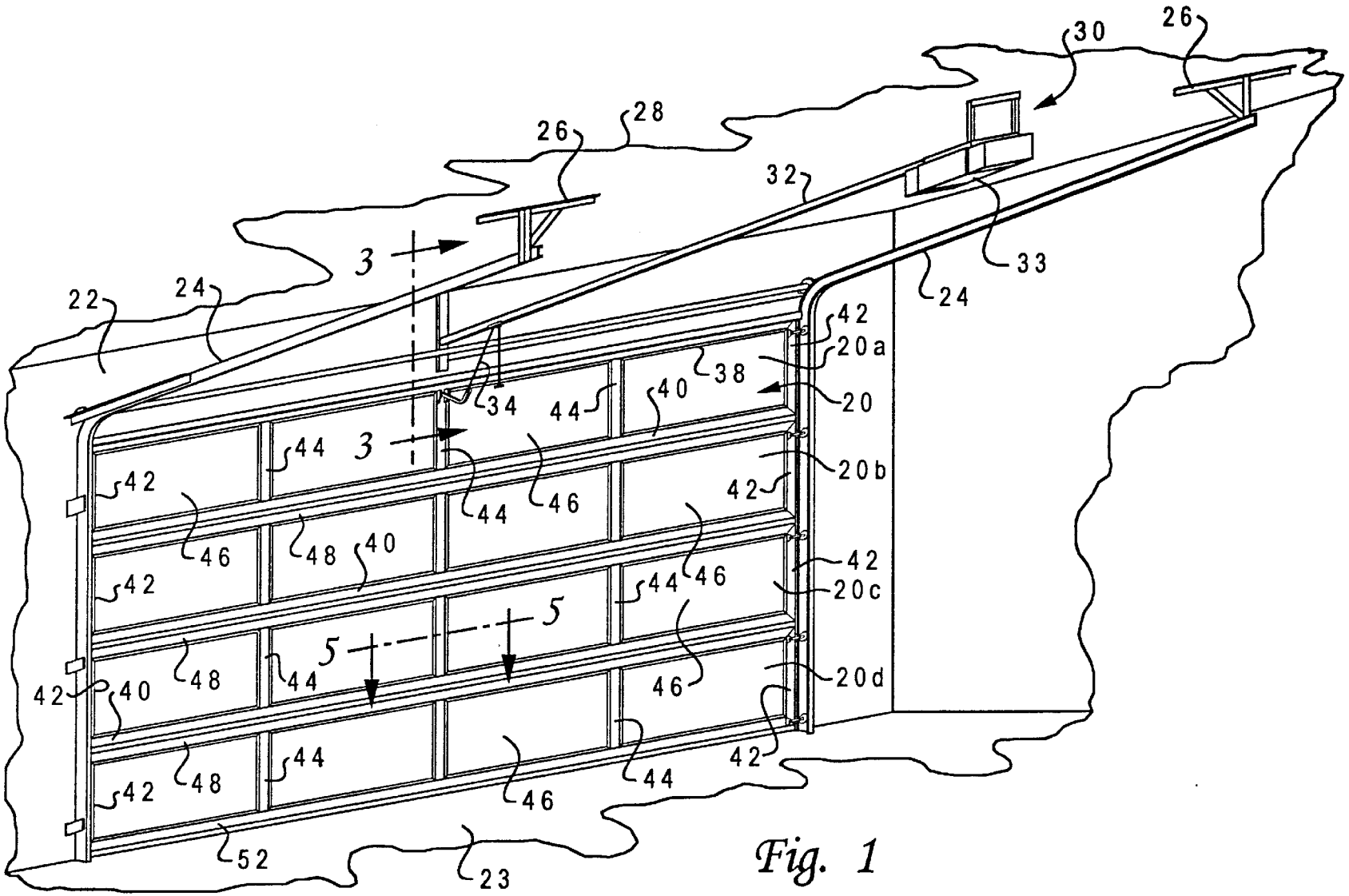
FIG. 1 is a perspective view of a sectional, upward acting garage door in accordance with the present invention.

In the description which follows like parts are marked throughout the specification and drawing with the same reference numerals, respectively. The drawing figures are not necessarily to scale and certain elements may be shown in schematic or generalized form or omitted from certain views in the interest of clarity and conciseness.

Figure 2:
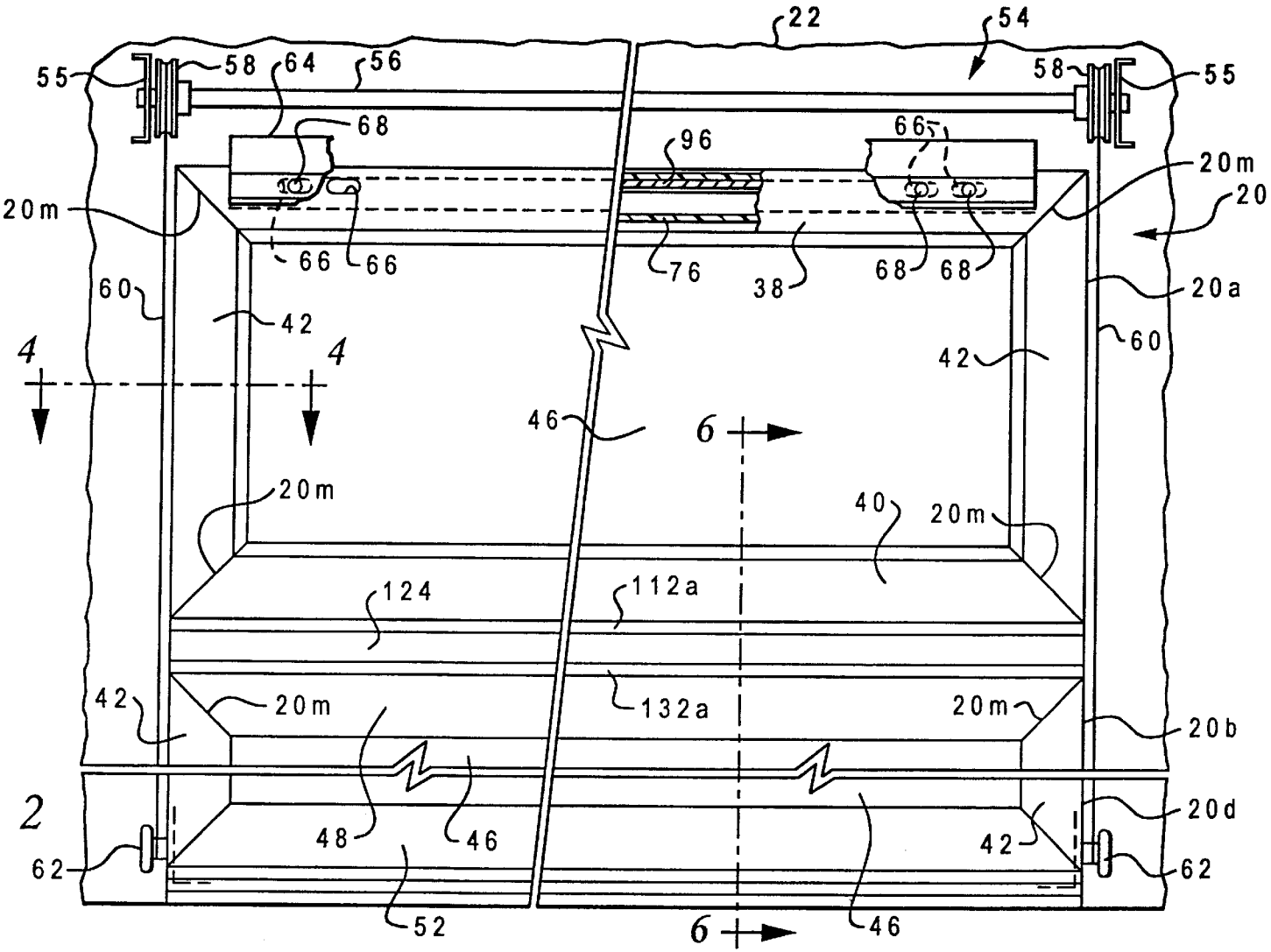
FIG. 2 is a partial inward facing side elevation of the door shown in FIG. 1.

Referring to FIGS. 1 and 2, a sectional, upward acting door in accordance with the present invention is illustrated and generally designated by the numeral 20. The door 20 is illustrated as a double width sectional garage door adapted to close over a vehicle entry opening formed in a vertical wall 22, for example. The door 20 is supported for movement between open and closed positions on spaced apart opposed guide tracks 24 of conventional construction, which tracks are supported at wall 22 in a conventional manner and also by depending support brackets 26 depending from a garage ceiling 28. The door 20 is operable to be moved between open and closed positions by a motor driven operator mechanism of conventional design and generally designated by the numeral 30. The operator mechanism 30 includes a motor unit 33 and a linear traversal device, such as a rotating screw or roller chain, not shown, and supported on a beam 32 extending between the operator mechanism 30 and the wall 22. An arm 34 is operable to interconnect the motor driven operator mechanism 30, including the aforementioned device, and the door 20. The arm 34 may be of conventional design and be connected to the operator mechanism in a conventional manner.

The door 20 is shown in a closed position in FIG. 1 covering the aforementioned opening in wall 22 and extending across the opening with its lower edge directly adjacent a floor 23. The door 20, in the embodiment shown, comprises four interconnected sections 20*a*, 20*b*, 20*c*, and 20*d*. The door sections 20*a* through 20*d*, are interconnected by improved hinge means between adjacent sections to be described in further detail herein.

Referring further to FIG. 1 and also FIG. 2, the door section 20*a* is characterized by an elongated top rail member 38, and a generally parallel and coextensive lower rail member 40 spaced from the top rail. The top and lower rail members 38 and 40 are interconnected by spaced apart vertical end stiles 42. Intermediate vertical stiles 44 also extend between the rail members 38 and 40. The rail members 38 and 40 and the stiles 42 and 44 support planar panel inserts 46 which may be removable from the section 20*a*, as will be described further herein.

Door sections 20*b*, and 20*c*, are identical and are each characterized by a longitudinal upper rail member 48, a longitudinal lower rail member 40, opposed vertical end stiles 42 and intermediate and center stiles 44 which also support panel inserts 46 therebetween in the same manner as for the section 20*a*.

Bottom section 20*d*, is characterized by an elongated upper rail 48, and a lower, generally parallel longitudinal bottom rail member 52 spaced therefrom. The rail members 48 and 52 are also interconnected by end stiles 42 and by center and intermediate stiles 44 which, in combination with the rails 48 and 52, support panel inserts 46. As shown in FIG. 2, the door 20 is also adapted to be counterbalanced by a conventional counterbalance mechanism, generally designated by the numeral 54, including opposed brackets 55 mounted on wall 22 and supporting a counterbalance shaft 56 having opposed cable drums 58 supported thereon for rotation to pay out or reel in opposed counterbalance cables 60. The cables 60 are connected at their lower ends to respective guide rollers 62 suitably connected to the bottom section 20*d*. Guide tracks 24 are omitted from FIG. 2. The counterbalance mechanism 54 may be of a conventional configuration wherein one or more torsion springs, not shown, are operable to bias the shaft 56 to rotate in a direction which exerts an upward acting force on the door 20 through the cables 60 to counterbalance at least a significant portion of the weight of the door.

Due to the concentrated force exerted on the door 20 by the operator mechanism 30 and considering the construction of the door, which will be explained in further detail herein, the upper section 20*a* advantageously includes an elongated support strut 64 extending substantially across the section 20*a* and secured to the rail 38 adjacent the upper horizontal edge thereof. In this regard the rail 38, which is an elongated substantially hollow extruded member, has plural spaced apart slots 66, four shown in FIG. 2, formed therein and coinciding with corresponding openings 68 formed in strut 64 for receiving fasteners for securing the strut to the door section 20*a*, also in a manner to be described further herein. Thanks to the provision of the strut 64, the forces exerted on the door 20 by the operator mechanism 30 are distributed over the door section 20*a* in such a way as to minimize any severe stress on or deflection of the rail 38.

Figure 3:
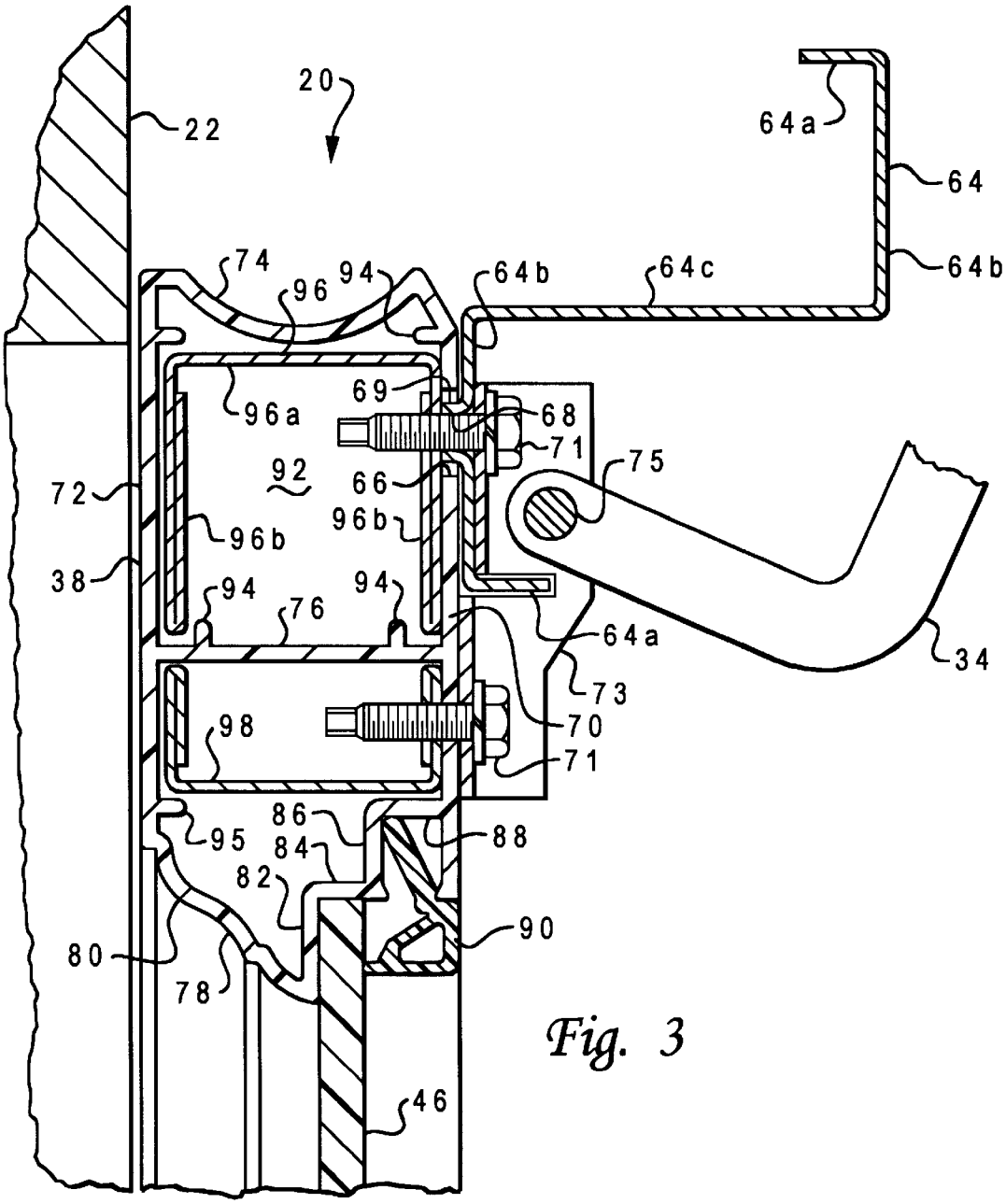
FIG. 3 is a detail section view taken generally along the line 3—3 of FIG. 1.

Referring now primarily to FIG. 3, the top rail 38 is shown in right cross-section in the closed position of door 20 disposed adjacent to wall 22. The top rail 38 is characterized as an elongated hollow plastic extrusion, preferably formed of a suitable all weather grade of a vinyl polymer and having a nominal wall thickness of about 0.070 inches to about 0.080 inches of opposed inner and outer side walls 70 and 72 formed integral with a connecting concave top wall 74, an intermediate wall 76 and a bottom wall 78. Bottom wall 78 has a suitable ornamental configured outer portion 80, a shoulder portion 82 substantially coplanar with walls 70 and 72, a transverse portion 84 contiguous with the shoulder 82 and a portion 86 forming with the inner wall 70 an elongated recess 88 for receiving a panel retainer strip 90. Retainer strip 90 is adapted for releasably retaining a panel insert 46 supported by the shoulder 82 and the transverse wall portion 84, as illustrated.

A generally rectangular elongated interior passage 92 is formed between walls 70, 72, 74 and 76, and elongated projections 94 are suitably formed by the respective wall portions, as shown, and projecting into the passage 92. Projections 94 are operable to stiffen the rail 38 and for supporting an elongated reinforcing member 96 which is substantially coextensive with the passage 92. A similar reinforcing member 98 may be disposed in the rail member 38 between the intermediate wall 76, a locating projection 95 and the wall portion 86, as shown. The reinforcing member 96 may be a rectangular cross-section metal tube or an inverted, folded flange metal channel member, as shown, having a web 96*a* and opposed flanges 96*b* with folded over distal end portions, as illustrated. The reinforcing member 98 may be similarly configured, as illustrated.

Figure 4:
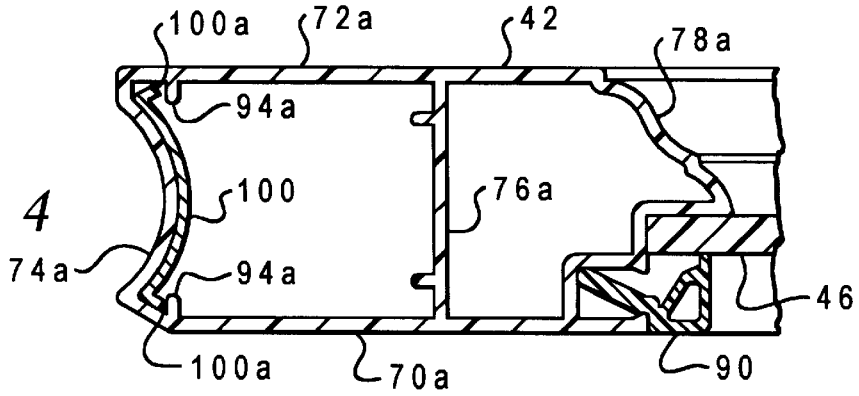
FIG. 4 is a section view taken generally along the line 4—4 of FIG. 2.

As shown in FIG. 4, the end stiles 42 may have a cross-sectional configuration substantially like the top rail 38 and may be formed of the same extrusion member to provide walls 70*a*, 72*a*, 74*a*, 76*a* and 78*a*. As shown in FIG. 4, two of the projections 94*a* adjacent the concave wall 74*a* for the end stile 42 may be provided to support a metal plate reinforcing member 100 having a somewhat arcuate shape to conform to the concave end wall 74*a* and having respective opposed tabs 100*a* engageable with the projections 94*a* to retain the reinforcing member 100 in the position shown. One or more reinforcing members 100 may be disposed in the end stiles 42 for supporting fasteners for connecting certain components to the end stiles.

Figure 5:
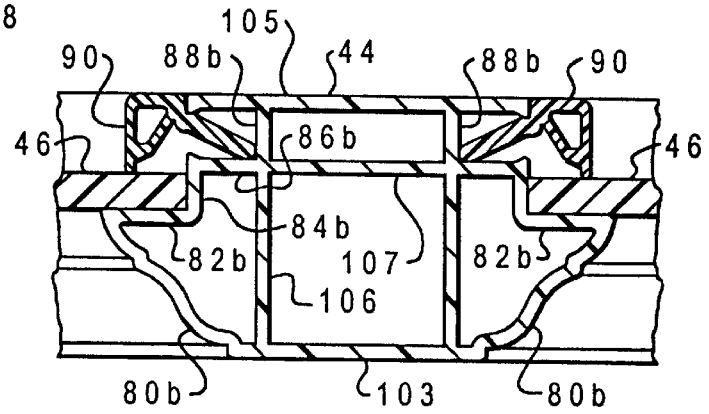
FIG. 5 is a detail section view taken generally along the line 5—5 of FIG. 1.

FIG. 5 is a cross-section view of one of the intermediate or center stiles 44 which are also formed of extruded polymer to have opposed, generally parallel, planar outer and inner wall portions 103 and 105, ornamental opposed wall portions 80*b*, shoulders 82*b* and transverse wall portions 84*b* which are contiguous with wall portions 86*b* defining slots 88*b* similar to the configuration of the rail member 38 and the stiles 42. Intermediate wall or web portions 106 and 107 reinforce the outer wall portions aforedescribed. The opposite ends of each of the stiles 44 are cut to conform to the cross-sectional shape of the wall portion 80, 82, 84 and 86 of the rails, such as the rail 38.

The cross-sectional configuration of lower rails 40, upper rails 48 and bottom rail 52 are essentially identical with respect to the architectural or ornamental shaped wall portions corresponding to the wall portions 80, 82, 84 and 86 shown for rails 38, end stiles 42 and center stiles 44. Other portions of the rails 40, 48 and 52 will be described further herein. As shown in FIG. 2, the door sections 20*a*, 20*b*, 20*c*, and 20*d*, are made up of rail members and end stile members which may be cut to form mitered joints 20*m*, as shown by way of example for door section 20*a*, which joints are suitably adhesively or thermally bonded to form a substantially rigid door section. However, if reinforcing members such as the channel members 96 and 98 are to be inserted in the rail members 38, 40, 48 or 52, such is preferably done before the door sections are assembled and the rails bonded to the end stiles 42. The center stiles 44 may also be bonded to the opposed rail members of each door section during assembly of the rails to the end stiles.

Thanks to the provision of the reinforcing members 96 and 98, additional stiffness of each of the door sections 20*a*, 20*b*, 20*c*, and 20*d*, is obtained. In a double width door, such as the door 20, it is advantageous to provide reinforcing members 96 in each of the rail members 38, 40, 48 and 52. However, in a door for a single vehicle width garage entry, reinforcing members 96 may be inserted only in the top rail 38, as shown in FIG. 3, and in the bottom rail 52. FIG. 6B shows a modified reinforcing member 96*t* disposed in the interior of bottom rail 52 and comprising a generally rectangular cross-section metal tube extending substantially coextensive with the bottom rail 52.

Referring again to FIG. 3, the strut 64 preferably has a somewhat Z shape including distal flanges 64*a*, parallel webs 64*b* and a connecting web 64*c*. One of the webs 64*b* is provided with the spaced apart fastener receiving holes 68 which are defined by cylindrical tubular flange portions 69, one shown in FIG. 3, which have a length greater than the wall thickness of the rail sidewall 70. FIG. 3 illustrates how the strut 64 is secured to the door 20 wherein a plurality of threaded fasteners 71 comprising, for example, self tapping metal screws, are operable to secure the strut 64 to a flange 96*b* of the reinforcing member 96. Plural fasteners 71 may be utilized to secure the strut 64 to the upper door section 20*a*, as shown, and wherein the strut 64 does not forcibly engage the rail wall 70. Due to the differential thermal expansion between a polymer material, such as vinyl, and a metal, such as steel or aluminum used for the strut 64 and the reinforcing member 96, it is important that the strut not be forcibly clamped to the wall 70 of the rail 38. In this way the differential thermal expansion between the rail 38, the strut 70 and the reinforcing member 96 over the substantial length of these members may be allowed to occur without distortion or damage, particularly to the rail 38.

The particular fasteners 71 shown in FIG. 3 also secure a somewhat channel shaped bracket 73 to the strut 64 and the reinforcing member 96, as shown. The bracket 73 is operable to form a connection point for the operator arm 34 which is suitably pivotally connected to the bracket 73 by a pivot pin 75, as shown. The bracket 73 may also be secured to the rail 38 by a fastener 71 which is threadedly engaged with the reinforcing member 98. The short length and width of the bracket 73 is such that the differential thermal expansion between the bracket and the wall 70 is not significant compared with the difference in lengths which will result from differential thermal expansion between members such as the strut 64 and the rail 38, due to the substantial length of these members, which ranges from 8 to 20 feet, for example.

Figure 6A:
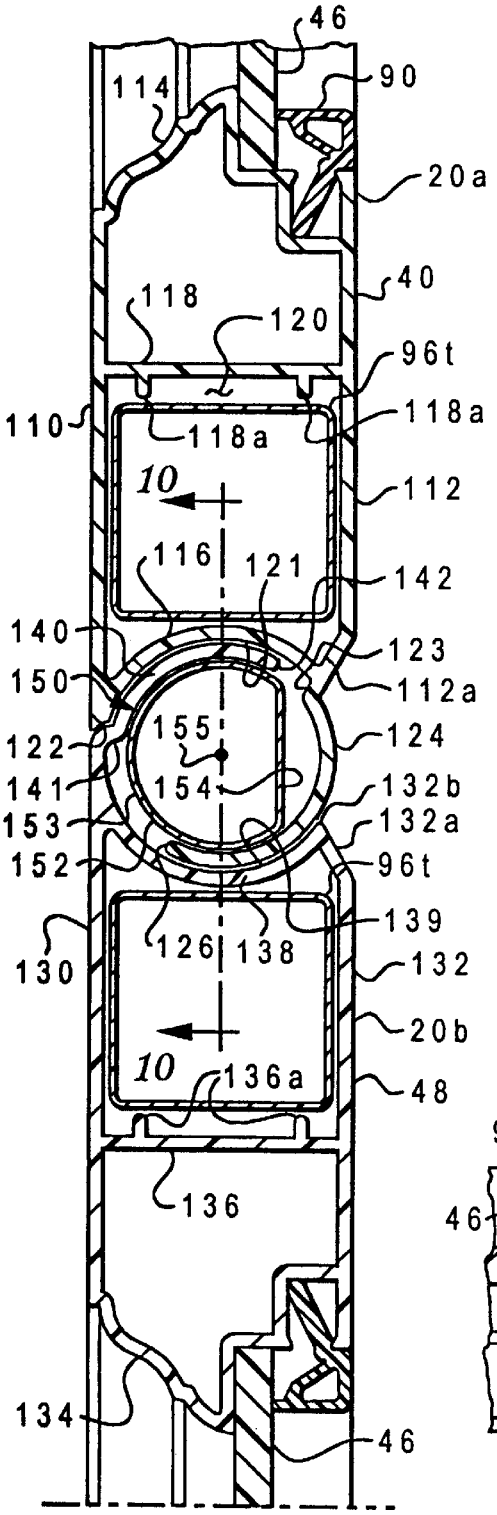
FIGS. 6A and 6B are section views taken generally along the line 6—6 of FIG. 2 showing a typical hinge connection between adjacent door sections and showing the door bottom rail, respectively.
Figure 6B:
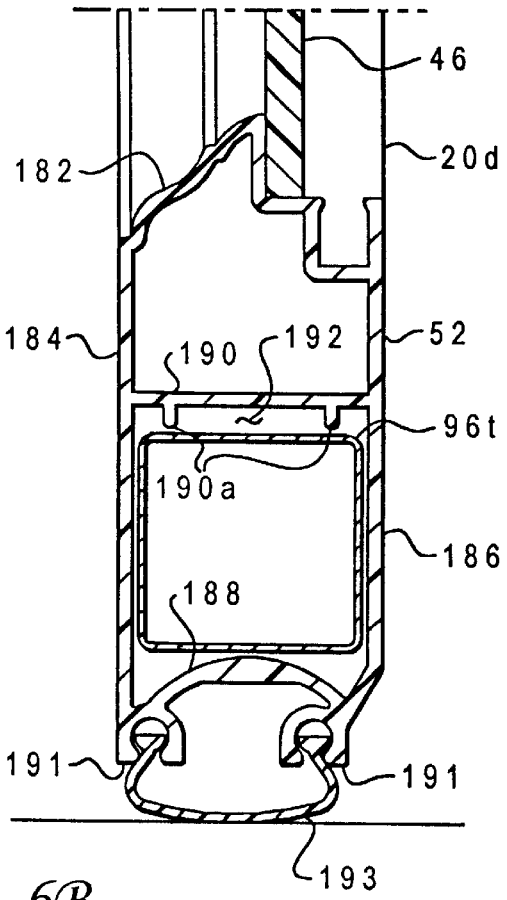

Referring now to FIG. 6A, rail members 40 and 48 are shown in cross section as part of adjacent connected door sections 20*a* and 20*b*, by way of example. The hinge connection between door sections 20*b*, and 20*c*, and between door sections 20*c*, and 20*d*, are identical to that shown in FIG. 6A. Rail members 40 and 48 are also formed as extrusions of a suitable material such as the aforementioned vinyl polymer. The polymer may include a lubricious material, such as silicone, as part of the polymer composition to provide self lubrication of the hinge structure described herein. Rail member 40 includes opposed, generally parallel, planar, spaced apart outer and inner walls 110 and 112, and a transverse top wall 114, configured identical to the wall 78 of rail member 38 and stiles 42, for supporting a panel insert 46 retained therein by a retainer 90. Outer and inner walls 110 and 112 are interconnected by a concave bottom wall 116 and an intermediate wall 118 forming an elongated interior space 120 for receiving an elongated reinforcing member 96*t*, for example. The member 96*t* may be replaced by a member 96, if desired. Projections 118*a* depend from the wall 118 to retain the reinforcing member 96*t* from substantial movement within the space 120. The bottom wall 116 forms an arcuate bearing surface 121 which terminates at a lower transverse edge 122 at the juncture between wall 116 and wall 110. The opposite end of bearing surface 121 terminates at a shoulder 123 defined by the juncture of an inclined wall portion 112*a* with a continuous arcuate bearing member 124 formed integral with the rail 40 and extending from the inclined wall portion 112*a*. Wall portion 112*a* is integral with the inner wall 112. The arcuate hinge bearing member 124 terminates at a distal edge 126 leaving a gap between edge 126 and edge 122 in the position of the door panels or sections shown in FIG. 6A.

In like manner, the upper rail 48 is formed of extruded polymer material, such as vinyl, and is defined by a planar outer wall 130, and a parallel, planar inner wall 132. Walls 130 and 132 are joined by a bottom wall 134 identical in configuration to walls 114 and 78, an intermediate wall 136 and an arcuate concave wall 138 forming a bearing surface 139 and interconnecting the walls 130 and 132, as shown. A short inwardly tapered or inclined portion 132*a* of wall 132 is provided, as shown, and terminates at an edge 132*b*. The rail 48 includes a continuous arcuate hinge bearing member 140 projecting from the wall 130 toward the wall 132 and is delimited by a distal edge 142. Bearing member 140 is operable to engage bearing surface 121 of the wall 116 and is rotatable relative to rail 40. As will be apparent from viewing FIG. 6A, bearing or hinge members 124 and 140 are operable to slide along the bearing surfaces 139 and 121, respectively, as door section 20*a* rotates relative to door section 20*b*, for example. Bearing surface 139 is delimited by a shoulder 141 formed at the juncture of bearing member 140 with the walls 130 and 138, as shown.

An elongated hinge member 150 is disposed between bearing members 124 and 140, and is characterized as a circular segment having a wall portion 152 and a generally planar wall portion 154 to give the hinge member a somewhat backward "D" cross sectional shape, viewing FIG. 6A. The hinge member 150 is preferably formed as a tubular member, as shown, to reduce its weight and may be formed of a suitable extrudable or rolled metal, such as aluminum or steel. When the hinge member 150 is positioned between the hinge bearing members 124 and 140 and is rotated to the position shown in FIG. 6A, it may be secured to the rail 48 by members to be described in further detail herein and thus remains fixed relative to bearing member 140 while allowing the rail 40 and door section 20*a* to pivot about a central axis 155 which is essentially the central axis of arcuate hinge bearing members 124 and 140 when assembled, as well as forming the axis of the arcuate bearing surfaces 139 and 121. Accordingly, the arcuate wall 138, forming the bearing surface 139 journals the bearing member 124 and the arcuate wall 116, forming the bearing surface 121 also journals the bearing member 140. Still further, the bearing member 124 is engageable with the outer cylindrical surface 153 of bearing member 150 to transfer forces between bearing member 124 and hinge member 150 and bearing member 140.

Figure 7:
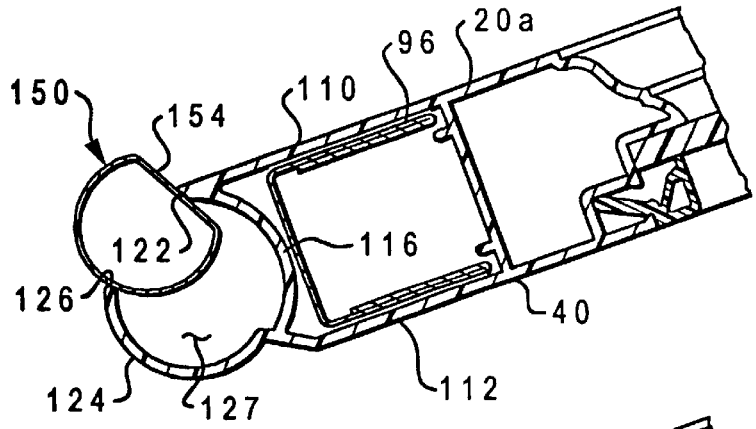
FIG. 7 is a detail section view of one of the lower rail members of a door section showing insertion and removal of a "D" shaped-or circular segment tubular hinge member.
Figure 8:
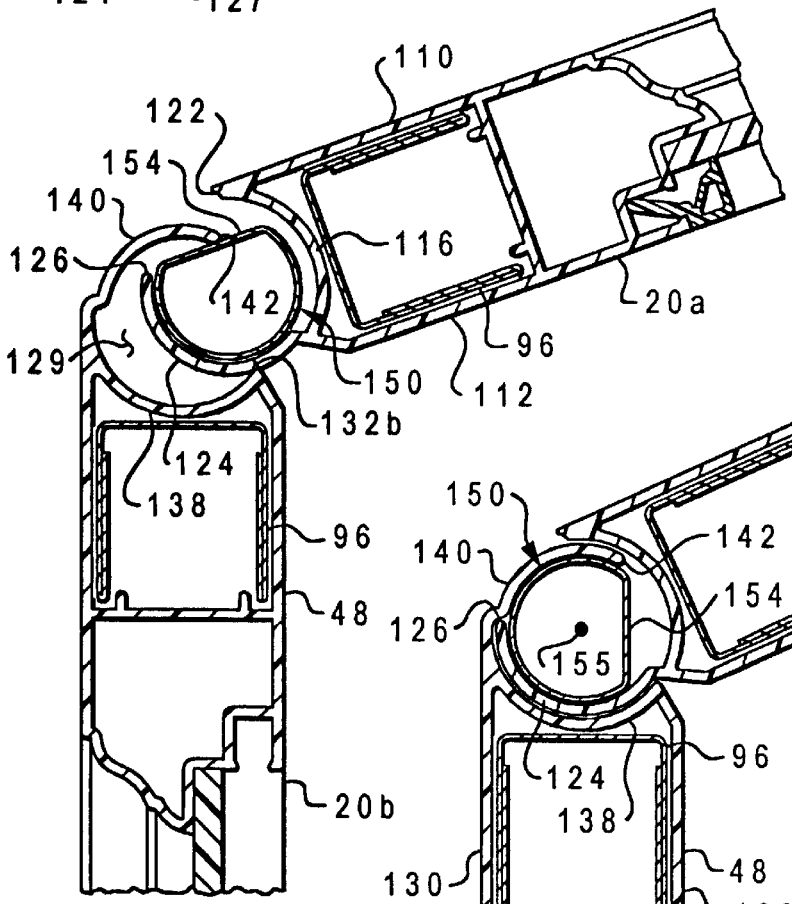
FIG. 8 is a detail section view showing upper and lower rail members of adjacent sections and a tubular hinge member being assembled to each other.
Figure 9:
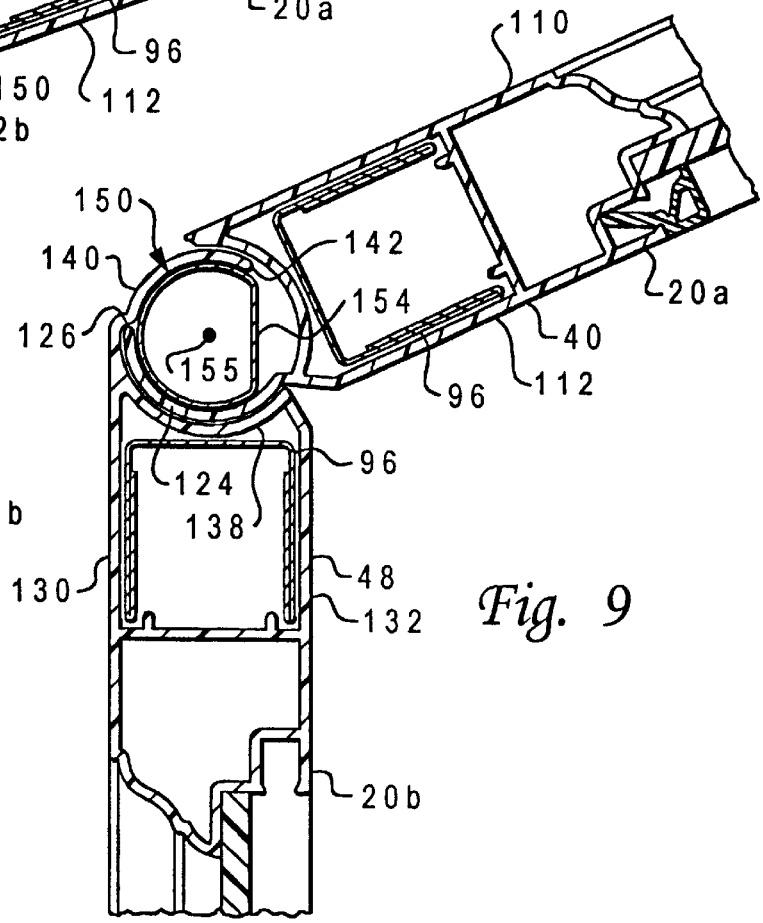
FIG. 9 is a detail section view showing one of the hinge connections between adjacent door sections in a folded position of one door section relative to the other.

One aforementioned advantage of the hinge assembly, comprising the hinge bearing members 124 and 140 and the hinge member 150, is illustrated in FIGS. 7, 8 and 9 which are views taken along the same section line as FIG. 6A. Referring to FIG. 7, the hinge assembly between adjacent door sections 20*a* and 20*b*, or 20*b*, and 20*c*, or 20*c*, and 20*d*, may be assembled or disassembled by placing the hinge member 150 within space 127 defined by bearing member 124 and arcuate wall 116 by sliding the hinge member 150 through the gap between the distal end 126 and the edge 122, as illustrated. Once the hinge member 150 is placed within the space 127 and cradled by the bearing member 124 it may be rotated to a position wherein the planar portion 154 is generally parallel to walls 110 and 112 of the rail 40 and aligned with the distal end 126. The bearing member 124 may then be inserted in space 129 defined between bearing member 140 and arcuate wall 138, as shown.

Once the bearing member 124 is journalled by the bearing surface 139, the hinge member 150 may be rotated to the position shown in FIG. 9, having the planar surface 154 generally parallel to walls 130 and 132 and aligned with distal end 142 of bearing member 140. In this position of the hinge member 150, the rail members 40 and 48 are locked together while permitting pivotal movement of the door sections of which they are a part, respectively, to rotate relative to each other between, generally, the position shown in FIG. 9 and the position shown in FIG. 6A.

The disassembly of the hinge connections between adjacent door sections 20*a* and 20*b*, 20*b*, and 20*c*, and 20*c*, and 20*d*, may be carried out by substantially reversing the steps above-described for each hinge. As previously discussed, a major advantage of the hinge assembly formed by the bearing members 124, 140 and the hinge member 150 resides in the fact that the hinge is continuous across the door, may be assembled laterally and the door sections do not require to be assembled by sliding the bearing members 124 and 140 into engagement by longitudinal movement of the adjacent door sections relative to each other. This lateral assembly and disassembly of the hinge is particularly important when a door is being assembled or disassembled within a building, such as a residential garage, wherein there is woefully inadequate space for assembling a garage door by moving one section of the door longitudinally its entire length relative to the adjacent section. Such action is unwieldy and difficult to accomplish, even when space is available.

Figure 10:
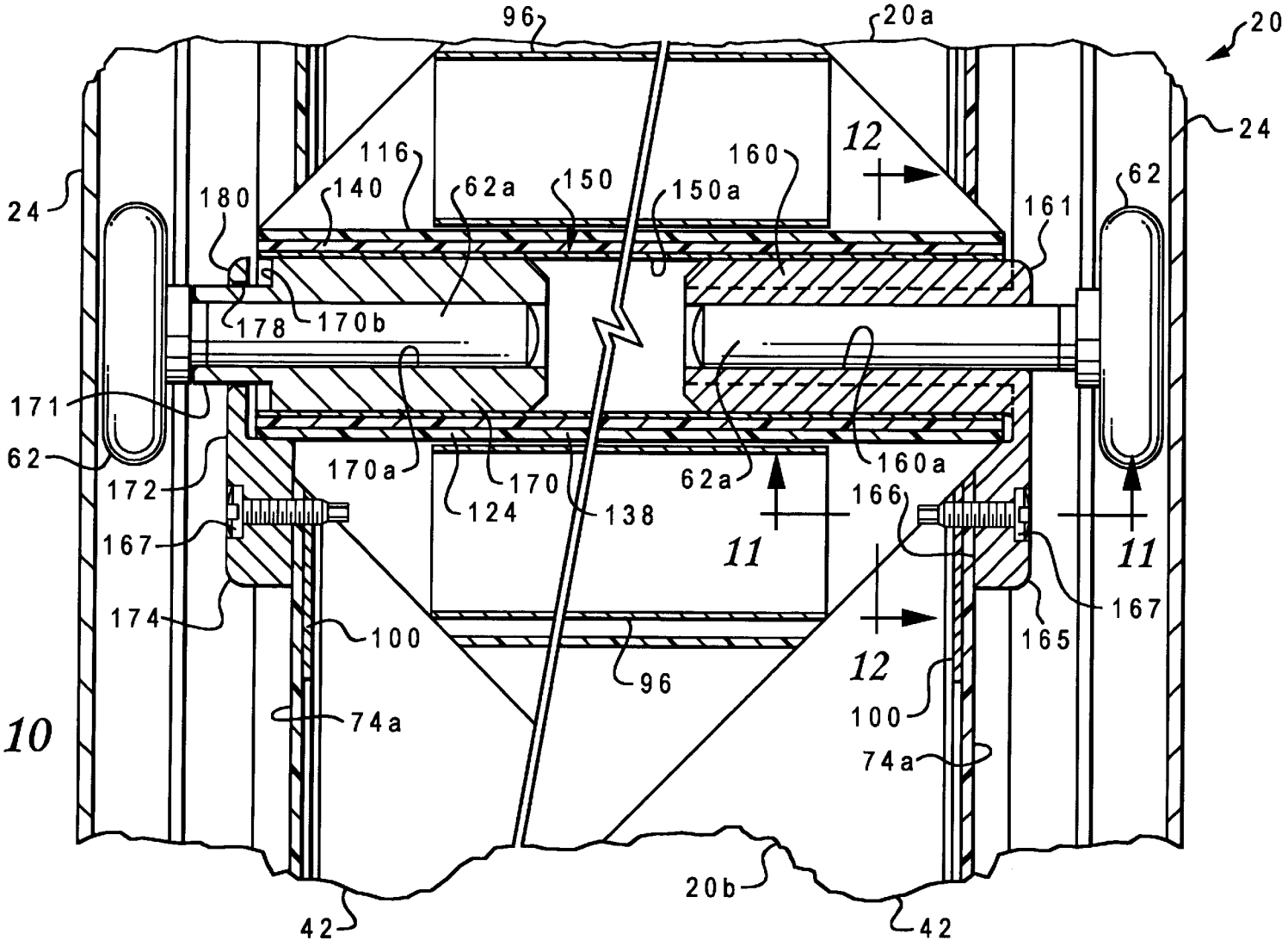
FIG. 10 is a detail section view taken generally along line 10—10 of FIG. 6A, showing opposite ends of the tubular hinge member and the associated retainer members for retaining the hinge member in its working position.
Figure 11:
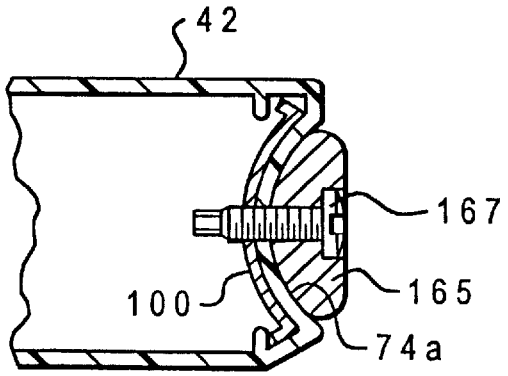
FIG. 11 is a detail section view taken from the line 11—11 of FIG. 10.
Figure 12:
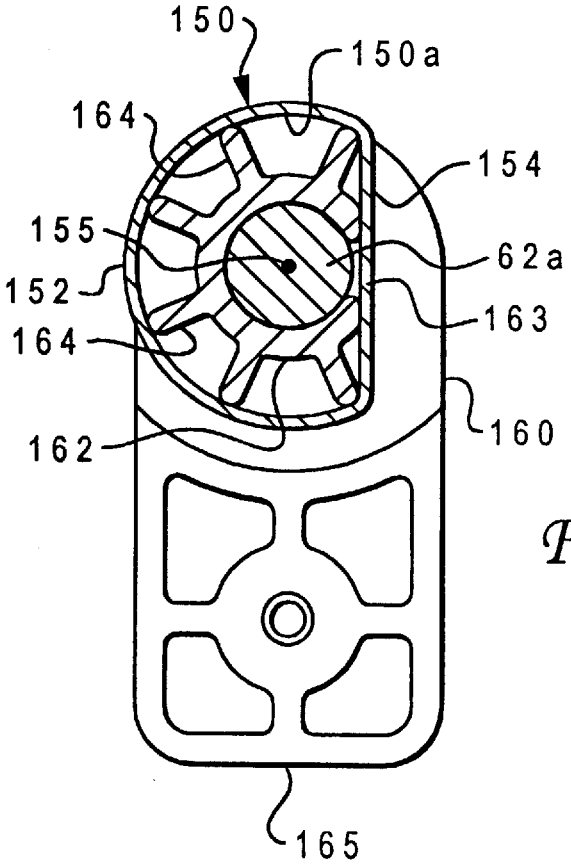
FIG. 12 is a view taken generally from the line 12—12 of FIG. 10.

Referring now to FIGS. 10, 11 and 12, the hinge member 150 is retained in its working position shown in FIGS. 6A, 9 and 10 by a retainer 160 comprising a member having a generally tubular hub 162, FIG. 12, and radially extending circumferentially spaced elongated fingers 164. The hub 162 has a planar surface 163 for registering with the inner surface of planar wall 154 of the hinge member 150 to prevent rotation of the hinge member with respect to the retainer member 160.

The retainer member 160 is insertable in bore 150*a* of hinge member 150 and includes, at its outer distal end 161, FIG. 10, a radially projecting arm 165 having a convex surface 166, FIGS. 10 and 11, operable to conform to the wall 74*a* of the end stile 42. The arm 165 is provided with a suitable bore for receiving a threaded fastener 167, such as a self-tapping panhead screw, which is operable to be drilled through the wall 74*a* and a reinforcing member 100 for securing the retainer to the end stile 42 of section 20*b*, for example. The arm 165 is aligned with the surface 163 such that, when the arm is nested against wall 74*a*, the hinge member 150 has its planar wall 154 aligned with the distal end 142 of bearing member 140. Accordingly, the hinge member 150 is secured against rotation relative to the bearing member 140. The hinge member 150 may be oriented in other positions of the planar wall 154 depending on the orientation of the surface 163 with respect to the arm 165. Retainer member 160 may be provided with a suitable bore 160*a* for receiving a support shaft 62*a* of a guide roller 62 or a similar guide member for the door 20.

Referring further to FIG. 10, a support member 170 is disposed in bore 150*a* of hinge member 150 at its opposite end, as shown, and retained in the bore by a retainer member 172 having a radially projecting arm portion 174 with a cross-sectional configuration similar to the arm portion 165 of retainer member 160. Arm portion 174 may be secured to wall 74*a* of the opposite end stile 42, also by a self-tapping threaded fastener 167 projecting through wall 74*a* and a reinforcing member 100, as shown. However, members 170 and 172 are not secured to each other and member 170 has a reduced diameter hub portion 171 which projects through a bore 178 formed in a boss 180 of retainer member 172. Boss 180 is spaced from the body of member 170 which is delimited by a transverse shoulder 170*b*. Shoulder 170*b* is spaced from retainer boss 180 a sufficient distance to allow differential thermal expansion between door section 20*b*, for example, and the hinge member 150. Support member 170 may include a bore 170*a* for supporting a shaft 62*a* of a door guide roller 62, as illustrated.

The support member 170 and retainer member 172 may be assembled to the door section 20*b*, after the hinge assembly is assembled and the hinge member 150 is rotated to its working position and retained therein by a retainer 160, as described above. If it is desired to disassemble a door section from its adjacent connected door section, the retainer member 172 and support member 170 are also preferably removed from the door section 20*b*, for example, before the hinge member 150 is rotated to a position to permit separation of the door sections from each other.

Referring briefly again to FIG. 6B, the cross-sectional configuration of extruded elongated bottom rail 52 is similar in some respects to the rails 38, 40 and 48 in that a transverse ornamental end wall 182 is provided which is substantially identical to the end walls 78, 114 and 134. End wall 182 is connected to opposed, spaced apart, planar side walls 184 and 186 which are also interconnected by a transverse bottom wall 188 and an intermediate wall 190, leaving an interior space 192 for insertion of a reinforcing member, such as a tubular member 96*t* or one of the aforementioned channel members 96. The bottom wall 188 is interposed between downwardly projecting opposed bosses 191 having suitable grooves formed therein for supporting and retaining a resilient bottom seal member 193, as shown. As described above, the bottom rail 52 may also be formed of extruded polymer material, such as vinyl, and is assembled to form the door section 20*d*, by mitered joints 20*m*, FIG. 2, between the bottom rail 52, the end stiles 42 and a rail member 48.

Figure 13:
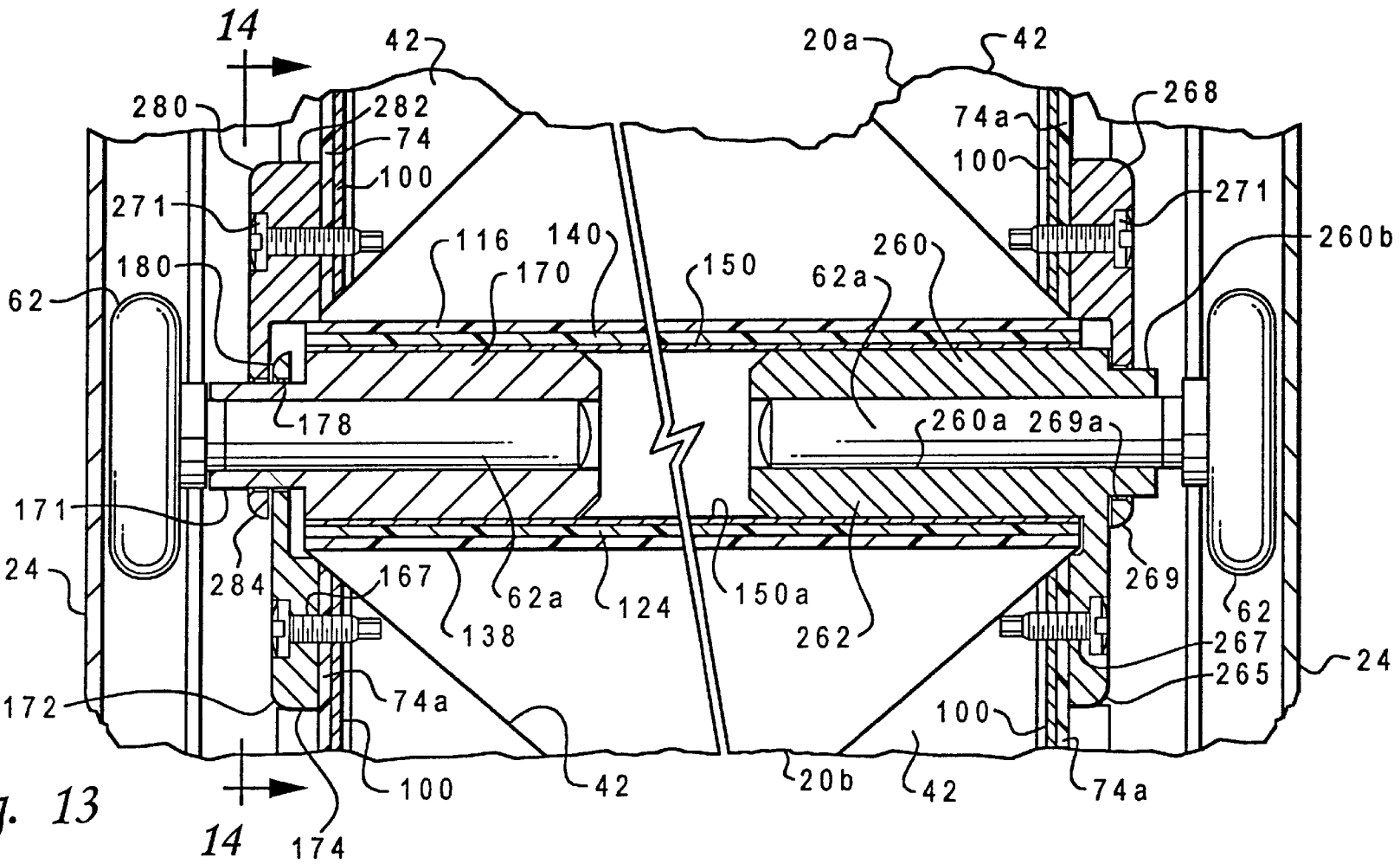
FIG. 13 is a section view similar to FIG. 10 showing an alternate embodiment of a hinge in accordance with the invention.
Figure 14:
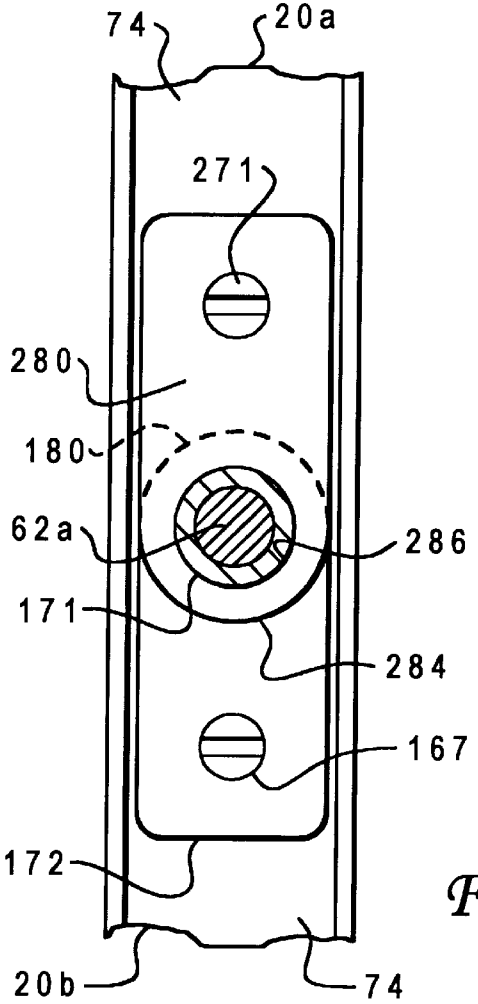
FIG. 14 is a view taken from line 14—14 of FIG. 13.

Referring now to FIGS. 13 and 14, another embodiment of an improved hinge assembly for the door 20, and similar doors, is illustrated. The hinge assembly shown in FIGS. 13 and 14 includes the door panels 20*a* and 20*b*, by way of example, each fitted with a bearing member 140 and a bearing member 124 and a hinge member 150 in the same manner as the hinge assembly previously described. However, in certain applications of sectional doors and the like, it may be desirable to provide additional hinge members for transferring the forces of opening and closing the door, as well as the weight of the door, between adjacent door panels or sections by additional hinge members which, in fact, can assume the entire hinge load between adjacent door sections so that the bearing members 124 and 140, for example, basically assume the role of light seals and weatherseals between adjacent door sections and also provide the so-called pinch-proof feature. In the hinge assembly shown in FIGS. 13 and 14, a support member or retainer 260 is shown disposed in the bore 150*a* of the hinge member 150 and includes a tubular hub portion 262 having the same configuration as the hub 162 of the retainer member 160. The retainer 260 includes a radially projecting arm 265 which is secured to the wall 74*a* of an end stile 42 by a panhead, self-tapping threaded fastener 267. The retainer member 260 is also provided with an axially projecting reduced diameter cylindrical pin portion 260*b*, as shown in FIG. 13.

A second hinge member 268 is secured to the wall 74*a* of an end stile 42 of door section 20*a* and includes a boss portion 269 having a suitable bore 269*a* formed therein and journaling the pin portion 260*b* of the retainer member 260. Hinge member 268 is also secured to wall 74*a* and member 100 by a self-tapping panhead threaded fastener 271. Retainer member 260 is provided with a bore 260*a* for receiving a shaft 62*a* of a roller assembly 62.

The hinge assembly shown in FIGS. 13 and 14 also includes a retainer member 172 having a boss portion 180 with a bore 178 journalling the hub portion 171 of a support member 170. A second hinge member 280 includes an arm portion 282 secured to wall 74*a* of an end stile 42 of door section 20*a* by a fastener 271. Hinge member 280 includes a radially projecting boss portion 284 having a suitable bore 286 formed therein for journalling the hub or pin portion 171. Accordingly, in the hinge assembly shown in FIGS. 13 and 14, a substantial portion or all of the loads imposed on the hinge connection between adjacent door sections, such as the door sections 20*a* and 20*b*, may be transferred between the door sections by members 172 and 280 by way of the member 170 and by the members 260 and 268, respectively. In this way, essentially little or no forces are transferred across the bearing members 124 and 140 except as a result of some elastic deflection of the door sections, in particularly wide doors, for example. However, a door provided with a hinge assembly between adjacent door sections, as shown in FIGS. 13 and 14, enjoys substantially all of the advantages of the hinge assembly described above in conjunction with FIGS. 6A and 7 through 12.

Figure 15:
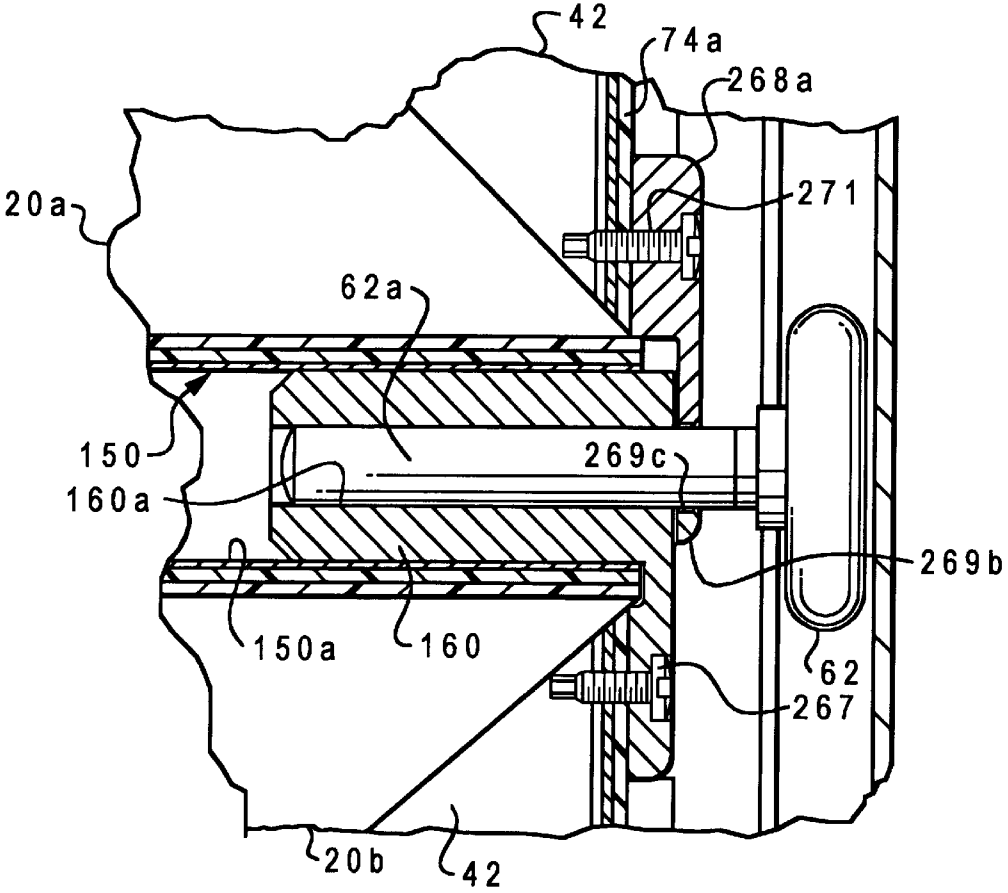
FIG. 15 is a detail section view showing a modification to one of the hinge members of the embodiment shown in FIGS. 13 and 14.

Referring briefly to FIG. 15, a hinge assembly in accordance with the invention may be provided wherein the support member or retainer 160 is disposed in the bore 150*a* of hinge member 150 and a hinge member 268*a*, similar to hinge member 268, is suitably connected to the end stile 42 of door section 20*a* by a fastener 271. The second hinge member 268*a* includes a boss portion 269*b* having a bore 269*c* which journals the shaft portion 62*a* of the guide roller 62. Accordingly, in the embodiment shown in FIG. 15, forces are transferred between door sections 20*a* and 20*b*, for example, through the hinge member 268*a*, the shaft 62*a* and the support member 160. Those skilled in the art will appreciate that the support member 170 may also be modified along with the hinge members 172 and 280 whereby these hinge members are adapted to transfer forces therebetween through shaft 62*a* of the other roller 62.

The assembly, disassembly and operation of the door 20 and the associated hinge assemblies is believed to be readily understandable to those of ordinary skill in the art from the foregoing description of the components thereof. The components not specifically described herein with regard to fabrication details and materials may be constructed using conventional materials and methods used in door manufacture. As mentioned previously, the rails 38, 40, 48 and 52, the end stiles 42 and the intermediate stiles 44 may be fabricated of extruded plastic or the like. However, these components may also be constructed in another manner.

Although preferred embodiments of the invention have been described in detail herein, those skilled in the art will recognize that various substitutions and modifications may be made without departing from the scope and spirit of the invention as recited in the appended claims.

What is claimed is:

1. A sectional door comprising a plurality of generally planar door sections hingedly connected to each other by hinge means between adjacent sections wherein at least two adjacent sections are connected by a hinge comprising a first hinge member connected to one of said sections, said first hinge member including a partial arcuate bearing portion delimited by a first gap, a second hinge member connected to the other of said sections, said second hinge member including a partial arcuate bearing portion delimited by a second gap, said partial arcuate bearing portion of said first hinge member being insertable in a space formed by said partial arcuate bearing portion of said second hinge member laterally with respect to a hinge axis of said hinge for operably connecting said first and second hinge members to each other, and a third hinge member disposed in a space formed by said partial arcuate bearing portion of one of said first and second hinge members and rotatable between a first position to permit lateral insertion of said partial arcuate bearing portion of said first hinge member in said space formed by said partial arcuate bearing portion of said second hinge member and a second position upon connection of said first and second hinge members to each other to retain said first hinge member connected to said second hinge member.

2. The door set forth in claim 1 wherein:

said third hinge member has a partial cylindrical cross section and a surface formed thereon to provide a cross-sectional dimension of said third hinge member less than the diameter of said cylindrical cross section.

3. The door set forth in claim 2 wherein:

said first gap of said first hinge member is delimited by a distal edge of said first hinge member which is sufficient to permit insertion of said third hinge member within said space formed by said partial arcuate bearing portion of said first hinge member and a wall of said section to which said first hinge member is connected.

4. The door set forth in claim 1 wherein:

said partial arcuate bearing portion of said first hinge member is engageable with a cooperating bearing surface on the other of said sections, said partial arcuate bearing portion of said second hinge member is engageable with a bearing surface on said one section and said third hinge member is engageable with at least one of said first and second hinge members, respectively, to provide for pivotal movement of one of said sections relative to the other of said sections.

5. The door set forth in claim 4 wherein:

one of said hinge members is connected to one of said sections in such a way as to define a shoulder engageable by the other hinge member when said one section moves relative to the other section.

6. The door set forth in claim 4 including:

a retainer member engageable with said third hinge member and operable to be secured to one of said door sections for positioning said third hinge member in a fixed position with respect to said one section.

7. The door set forth in claim 6 wherein:

said retainer member comprises an elongated hub portion insertable within a bore in one end of said third hinge member and said retainer member includes a transversely extending arm portion engageable with a side edge of said one section for securing said retainer member and said third hinge member against rotation relative to said one section.

8. The door set forth in claim 1 wherein:

said hinge members extend substantially across respective lower and upper edges of said adjacent sections between opposed lateral sides of said adjacent sections, respectively.

9. The door set forth in claim 1 wherein:

said first hinge member is formed integral with a lower rail member of said one section and said second hinge member is formed integral with an upper rail member of said other section.

10. The door set forth in claim 9 wherein:

said rail members are formed of extruded material.

11. The door set forth in claim 1 wherein:

at least one of said sections includes opposed side walls and opposed end walls forming an interior space adjacent said hinge member and an elongated reinforcing member disposed in said space for reinforcing said one section adjacent said hinge.

12. The door set forth in claim 11 wherein:

the other of said sections includes an elongated rail member including opposed side walls, an end wall, a wall defining a bearing surface for said hinge member and an interior space between said walls, and a reinforcing member disposed in said space for reinforcing said other section adjacent said hinge.

13. A hinge assembly for connecting a first structural member to a second structural member, said hinge assembly comprising:

a first hinge member connected to one of said structural members and including a partial arcuate bearing portion delimited by a first gap, a second hinge member connected to the other of said structural members and including a partial arcuate bearing portion delimited by a second gap, said partial arcuate bearing portion of said first hinge member being insertable in a space formed by said partial arcuate bearing portion of said second hinge member laterally with respect to a pivot axis of said hinge assembly through said second gap, and a third hinge member operable to be releasably connected to one of said structural members and disposed in a space formed by said partial arcuate bearing portion of said first hinge member and rotatable with respect to said one structural member to a position for retaining said first and second hinge members connected to each other, said hinge members being operable to provide for pivotal movement of one of said structural members with respect to the other of said structural members about said pivot axis, said first hinge member and said second hinge member being coextensive over at least a portion of said structural members and said structural members being operable to be assembled and disassembled by moving said structural members laterally with respect to each other and said pivot axis.

14. The hinge assembly set forth in claim 13 wherein:

said partial arcuate bearing portion of said first hinge member is engageable with a cooperating bearing surface on the other of said structural members.

15. The hinge assembly set forth in claim 14, wherein:

said partial arcuate bearing portion of said second hinge member is engageable with a bearing surface on said one structural member and said third hinge member is engageable with one of said first and second hinge members, respectively.

16. The hinge assembly set forth in claim 14 including:

a retainer member engageable with said third hinge member and operable to be secured to one of said structural members for positioning said third hinge member in a fixed position with respect to said one structural member.

17. The hinge assembly set forth in claim 16 wherein:

said retainer member comprises an elongated hub portion insertable within a bore in said third hinge member and said retainer member includes a transversely extending arm portion engageable with said one structural member for securing said third hinge member against rotation relative to said one structural member.

18. The hinge assembly set forth in claim 13 wherein:

said third hinge member has a partial cylindrical cross section and a surface formed thereon providing a cross sectional dimension of said third hinge member less than the diameter of said cylindrical cross section.

19. The hinge assembly set forth in claim 18 wherein:

said first gap is sufficient to permit insertion of said third hinge member within a space delimited by said first hinge member and a bearing surface of said structural member to which said first hinge member is connected.

20. The hinge assembly set forth in claim 13 wherein:

said first and second hinge members are formed integral with respective ones of said structural members.

21. In a sectional door comprising a plurality of generally planar door sections hingedly connected to each other by hinge means between adjacent sections, said hinge means comprising:

a first hinge member connected to one of said sections, said first hinge member comprising an arcuate bearing member engageable with a cooperating bearing surface on another of said sections;

a second hinge member connected to said another section, said second hinge member comprising an arcuate bearing member engageable with a bearing surface on said one section; and, a third hinge member engageable with one of said first and second hinge members and operable to be releasably connected to one of said sections, said hinge members being operable to provide for pivotal movement of one of said sections with respect to the other of said sections, said third hinge member including a partial cylindrical cross section and a surface formed thereon to provide a cross-sectional dimension of said third hinge member less than the diameter of said cylindrical cross section so as to permit insertion of said third hinge member through a gap delimited by a distal edge of said arcuate bearing member of one of said hinge members for disposition in a space formed by said arcuate bearing member of one of said hinge members to retain said first and second hinge members connected to each other.

22. The door set forth in claim 21 wherein:

one of said hinge members is connected to one of said sections in such a way as to define a shoulder engageable by the other hinge member when said one section moves relative to said another section.

23. The door set forth in claim 21 including:

a retainer member engageable with said third hinge member and operable to be secured to one of said sections for positioning said third hinge member in a fixed position with respect to said one section.

24. In a sectional door comprising a plurality of interconnected door sections, a hinge for connecting adjacent ones of said door sections to each other comprising opposed first hinge members connected to one of said door sections, at opposed side edges of said one door section, respectively, opposed second hinge members connected to the other of said door sections at opposed side edges of said other door section, respectively, and hinge pin means, respectively, at opposite ends of said door sections forming a pivot connection between respective ones of said first hinge members connected to said one door section and said second hinge members connected to said other door section for transferring forces between said door sections, arcuate members disposed on each of said door sections extending between said hinge members and extending in overlapping relationship to each other to form at least one of a weather seal and light seal between said door sections when said door sections are pivoted relative to each other; and an elongated tubular hinge member extending between and supporting said pin means, respectively, and disposed in a space defined by said arcuate members and engageable with said arcuate members for transferring at least partial door opening and closing forces between said interconnected door sections.

25. The door set forth in claim 24 wherein:

said arcuate members are engageable with cooperating bearing surfaces formed on respective ones of said adjacent door sections, respectively.

26. The door set forth in claim 24 wherein:

one of said arcuate members has a gap delimited by a distal edge of said one arcuate member sufficient to permit insertion of said tubular hinge member within a space delimited by said one arcuate member and a wall of a door section to which said one arcuate member is connected.

27. The door set forth in claim 24 wherein:

said arcuate members extend substantially across adjacent edges of said adjacent door sections between opposed lateral sides of said door sections, respectively.

28. The door set forth in claim 24 wherein:

said pin means comprises shaft portions of respective guide members for guiding said door for movement between open and closed positions.

29. A sectional door comprising a plurality of generally planar door sections hingedly connected to each other by hinge means between adjacent sections wherein at least two adjacent sections are connected by a hinge comprising a first hinge member connected to one of said sections and comprising a partial arcuate bearing member engageable with a cooperating bearing surface on the other of said sections, a second hinge member connected to the other of said sections and including a partial arcuate bearing member engageable with a bearing surface on said one section and a third hinge member operable to be releasably connected to one of said sections, said third hinge member is engageable with at least one of said first and second hinge members, respectively, to provide for pivotal movement of one of said sections relative to the other of said sections, said hinge members being operable to provide for pivotal movement of one of said sections with respect to the other of said sections about a hinge axis and said hinge being further operable to be assembled and disassembled by moving said section laterally with respect to each other and said axis, a retainer member engageable with said third hinge member and operable to be secured to one of said door sections for positioning said third hinge member in a fixed position with respect to said one section, said retainer member comprising an elongated hub portion insertable within a bore in one end of said third hinge member, said retainer member including a transversely extending arm portion engageable with a side edge of said one section for securing said retainer member and said third hinge member against rotation relative to said one section, a support member insertable within said bore of said third hinge member in an end of said third hinge member opposite said one end and a retainer arm operable to be connected to an opposite side edge of said one section for retaining said support member in said bore of said third hinge member.

30. The door set forth in claim 29 wherein:

said retainer member and said support member each include means for supporting a guide member for guiding said door when moving between opened and closed positions.

31. The door set forth in claim 30 wherein:

said bore in said third hinge member and said means for supporting said guide member in said retainer member and said support member are coaxial with a pivot axis of said hinge.

32. In a sectional door comprising a plurality of generally planar door sections hingedly connected to each other by hinge means between adjacent sections, said hinge means comprising:

a first hinge member connected to one of said sections, said first hinge member comprising an arcuate bearing member engageable with a cooperating bearing surface on another of said sections;

a second hinge member connected to said another section, said second hinge member comprising an arcuate bearing member engageable with a bearing surface on said one section;

a third hinge member engageable with one of said first and second hinge members and operable to be releasably connected to one of said sections, said hinge members being operable to provide for pivotal movement of one of said sections with respect to the other of said sections;

a retainer member engageable with said third hinge member and operable to be secured to one of said sections for positioning said third hinge member in a fixed position with respect to said one section, said retainer member comprising an elongated hub portion insertable within a bore in one end of said third hinge member, said retainer member also including an arm portion engageable with said one section for securing said retainer member and said third hinge member against rotation relative to said one section; and said hinge means includes a support member insertable within said bore of said third hinge member in an end of said third hinge member opposite said one end and a retainer arm operable to be connected to said one section for retaining said support member in said bore of said third hinge member.

33. The door set forth in claim 32 wherein:

said retainer member and said support member each include means for supporting a guide member for guiding said door when moving between opened and closed positions.

* * * * *